United States Patent [19]

Quinn

[11] Patent Number: 4,642,251

[45] Date of Patent: Feb. 10, 1987

[54] HONEY-MOON

[76] Inventor: Susanne M. Quinn, 401 E. 80th St., Apt. 27-J, New York, N.Y. 10021

[21] Appl. No.: 826,238

[22] Filed: Feb. 5, 1986

[51] Int. Cl.[4] ..... B44F 9/00

[52] U.S. Cl. ..... 428/7; 215/19; 426/104; 428/13; 428/542.4

[58] Field of Search ..... 426/104, 105; 428/13, 428/7, 542.4; 215/19

[56] References Cited

U.S. PATENT DOCUMENTS

| | | | |
|---|---|---|---|
| 2,440,205 | 4/1948 | McLain | 428/13 X |
| 2,591,328 | 4/1952 | Yanik | 426/104 X |
| 2,731,672 | 1/1956 | Davis et al. | 428/13 X |
| 2,917,856 | 12/1959 | Soloff | 428/13 |
| 4,240,218 | 12/1980 | Kotzin | 428/13 X |
| 4,253,333 | 3/1981 | Schneider | 73/253 |
| 4,572,412 | 2/1986 | Brach et al. | 222/574 X |

*Primary Examiner*—Henry F. Epstein
*Attorney, Agent, or Firm*—Richard L. Miller

[57] ABSTRACT

An ornamental device is provided and consists of a clear plastic block that has a crescent moon shaped hollow chamber within and honey liquid placed in the chamber so as to be sealed therein.

3 Claims, 3 Drawing Figures

HONEY-MOON

BACKGROUND OF THE INVENTION

The instant invention relates generally to ornamental devices and more specifically it relates to a honey-moon solid clear plastic block.

Numerous ornamental devices have been provided in prior art that are adapted to display articles within transparent enclosures. For example, U.S. Pat. Nos. 2,440,205, 2,917,856 and 4,240,218 all are illustrative of such prior art. While these units may be suitable for the particular purpose to which they address, they would not be as suitable for the purposes of the present invention as heretofore described.

SUMMARY OF THE INVENTION

A primary object of the present invention is to provide a honey-moon solid clear plastic block that will overcome the short comings of the prior art devices.

Another object is to provide a honey-moon solid clear plastic block in which the middle of the block contains a hollow chamber in the shape of a crescent moon filled with honey liquid.

An additional object is to provide honey-moon solid clear plastic block that is fabricated out of two halves, each half having one portion of the hollow chamber on its mating surface so that the honey liquid can be placed into one of the portions of the hollow chamber before the two halves are assembled together.

A further object is to provide a honey-moon solid clear plastic block that is simple and easy to use.

A still further object is to provide a honey-moon solid clear plastic block that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

The figures in the drawings are briefly described as follows.

DETAILED DESCRIPTION OF THE PREFERRED EMBODIMENTS

Figure 1:
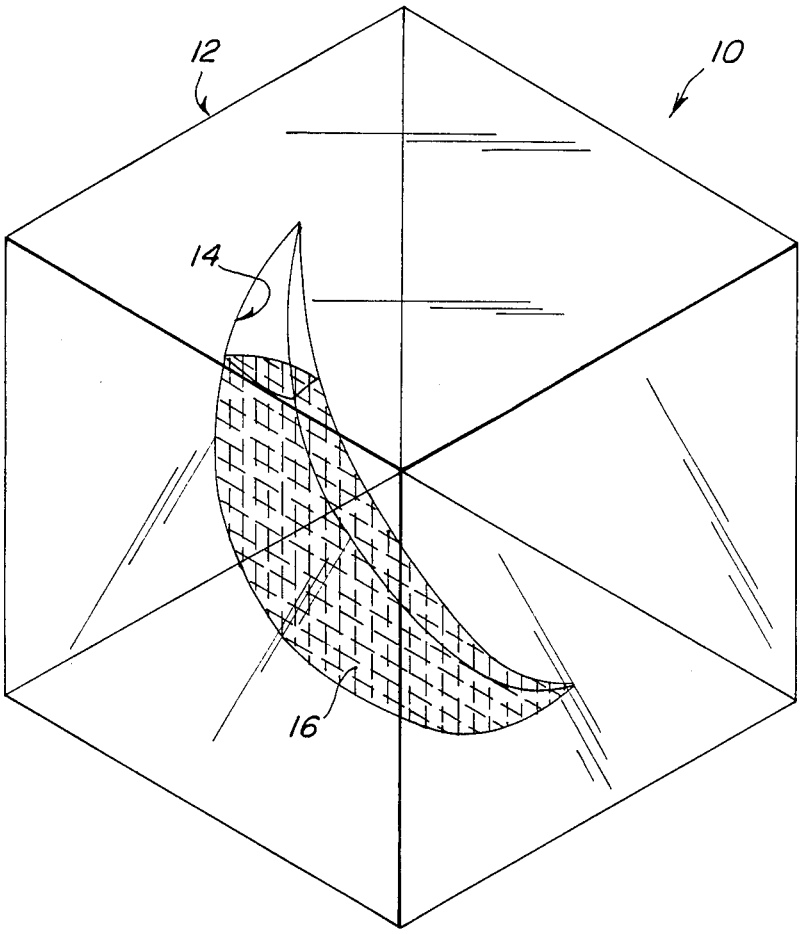
FIG. 1 is a perspective view of the invention.

Turning now descriptively to the drawings, in which similar reference characters denote similar elements throughout the several views, FIG. 1 illustrates an ornamental device 10 that consists of a clear plastic block 12 that has a hollow chamber 14 within being in the shape of a crescent moon. Honey liquid 16 is placed in the crescent moon shaped hollow chamber 14 of the clear plastic block 12 so as to be sealed therein.

Figure 2:
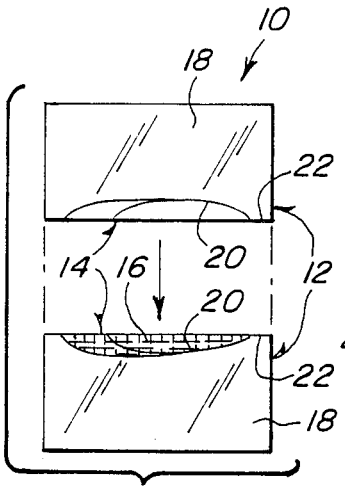
FIG. 2 is an exploded front view of the invention showing the two halves of the block of clear plastic with honey liquid placed therewithin.
Figure 3:
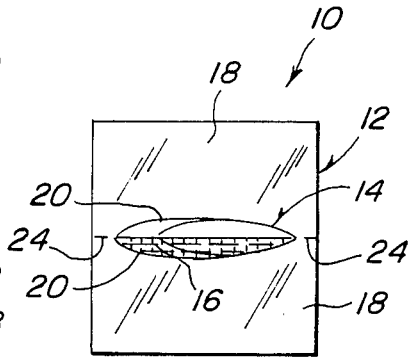
FIG. 3 is a front view of the invention showing the two halves assembled together.

FIGS. 2 and 3 show the clear plastic block is 12 formed in two halves 18. Each of the halves 18 has one longitudinal portion 20 of the crescent moon shaped hollow chamber 14 on its mating surface 22. The honey liquid 16 can be placed into one of the portions 20 before the two halves 18 are assembled together as shown in FIG. 2. The two halves 18 of the clear plastic block 12 are assembled together with a cement solvent, 24 so as to create the illusion of an invisible seam therebetween as shown in FIG. 3. The two halves 18 of the clear plastic block 12 are fabricated out of polymerized acrylic resin which is solid under the trademarks LUCITE ® and PLEXIGLAS ® while the honey liquid 16 is indeed honey extracted from a bees nest.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. An ornamental device comprising:

(a) a clear plastic block having a sealed hollow chamber within being in the shape of a crescent moon; and (b) honey liquid placed in said crescent moon shaped hollow chamber of said clear plastic block so as to be sealed therein, wherein said clear plastic block is formed in two halves, each of said halves having one longitudinal portion of said crescent moon shaped hollow chamber on its mating surface so that said honey liquid can be placed into one of said portions before said two halves are assembled together.

2. An ornamental device as recited in claim 1 wherein said two halves of said clear plastic block are assembled together with a cement solvent so as to create the illusion of an invisible seam therebetween.

3. An ornamental device as recited in claim 2 wherein said two halves of said clear plastic block are fabricated out of polymerized acrylic resin.

* * * * *